US006394680B1

(12) United States Patent
Poghosyan et al.

(10) Patent No.: US 6,394,680 B1
(45) Date of Patent: May 28, 2002

(54) MULTI-PURPOSE WRITING INSTRUMENT

(76) Inventors: Armen Poghosyan; Mariam Vardanyan, both of 18540 Plummer St. #148, Northridge, CA (US) 91324

( * ) Notice: Subject to any disclaimer, the term of this patent is extended or adjusted under 35 U.S.C. 154(b) by 0 days.

(21) Appl. No.: 09/933,434

(22) Filed: Aug. 20, 2001

(51) Int. Cl.[7] ..... B43K 29/00
(52) U.S. Cl. ..... 401/195; 401/52; D19/38
(58) Field of Search ..... 401/195, 52; D19/36, D19/35, 38

(56) References Cited

U.S. PATENT DOCUMENTS

| | | | | |
|---|---|---|---|---|
| 1,611,835 A | * | 12/1926 | Keaney | |
| 1,649,353 A | * | 11/1927 | Kirk | |
| 3,550,282 A | * | 12/1970 | Tsunemi | |
| D286,646 S | * | 11/1986 | Mori | D19/36 |
| 5,240,338 A | * | 8/1993 | Jye | 401/195 |
| D352,063 S | * | 11/1994 | de Haro Egea et al. | D19/36 |
| 5,546,664 A | * | 8/1996 | Kuo | 33/30.3 |
| D420,702 S | * | 2/2000 | Chang | D19/36 |

FOREIGN PATENT DOCUMENTS

| | | | | |
|---|---|---|---|---|
| DE | 3735416 A1 | * | 5/1989 | 401/195 |
| IT | I-424004 | * | 8/1957 | 401/52 |

* cited by examiner

*Primary Examiner*—Gregory L. Huson
*Assistant Examiner*—Huyen Le
(74) *Attorney, Agent, or Firm*—Goldstein Law Offices P.C.

(57) ABSTRACT

A multi-purpose writing instrument including a cylindrical casing having an upper end, a lower end, and a cylindrical side wall therebetween. The lower end has a writing tip removably coupled thereto. The cylindrical side wall has an elongated recess formed therein extending between the upper end and the lower end. An elongated pivot bar is removably coupled with the cylindrical casing. The elongated pivot bar has an upper end and a lower end. The pivot bar is selectively received within the elongated recess of the cylindrical casing in a closed orientation. A needle assembly extends outwardly from the pivot bar. The lower end of the pivot bar has a ring pivotally coupled thereto. The ring is positionable between the lower end of the cylindrical casing and the writing tip thereof whereby the pivot bar can be raised for positioning within the elongated recess, lowered to a position perpendicular to the cylindrical casing, or removed from the cylindrical casing.

7 Claims, 5 Drawing Sheets

MULTI-PURPOSE WRITING INSTRUMENT

BACKGROUND OF THE INVENTION

The present invention relates to a multi-purpose writing instrument and more particularly pertains to a writing instrument which allows a number of different functions to be performed with a single instrument.

The use of combined compass and pen instruments is known in the prior art. More specifically, combined compass and pen instruments heretofore devised and utilized for the purpose of combining the functions of a compass and a pen are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,815,881 to Chern discloses a multi-purpose combination writing instrument. U.S. Pat. No. 2,637,906 to Giossi discloses a combination scribing and compass unit. U.S. Pat. No. 2,573,760 to Cherne discloses a mechanical compass pencil. U.S. Pat. No. 3,797,117 to Gimenez discloses a compass ballpoint pen. U.S. Pat. No. Des. 419,188 discloses the ornamental design for a combined compass and writing instrument. U.S. Pat. No. 1,950,960 to Wisser discloses a flexible writing implement.

While these devices fulfill their respective, particular objective and requirements, the aforementioned patents do not describe a multi-purpose writing instrument for allowing a number of different functions to be performed with a single instrument.

In this respect, the multi-purpose writing instrument according to the present invention substantially departs from the conventional concepts and designs of the prior art, and in doing so provides an apparatus primarily developed for the purpose of allowing a number of different functions to be performed with a single instrument.

Therefore, it can be appreciated that there exists a continuing need for a new and improved multi-purpose writing instrument which can be used for allowing a number of different functions to be performed with a single instrument. In this regard, the present invention substantially fulfills this need.

SUMMARY OF THE INVENTION

In view of the foregoing disadvantages inherent in the known types of combined compass and pen instruments now present in the prior art, the present invention provides an improved multi-purpose writing instrument. As such, the general purpose of the present invention, which will be described subsequently in greater detail, is to provide a new and improved multi-purpose writing instrument which has all the advantages of the prior art and none of the disadvantages.

To attain this, the present invention essentially comprises a cylindrical casing having an upper end, a lower end, and a cylindrical side wall therebetween. The upper end has an eraser head coupled therewith. The lower end has a writing tip removably coupled thereto. The cylindrical side wall has an elongated recess formed therein extending between the upper end and the lower end. An elongated pivot bar has an upper end and a lower end. The elongated pivot bar is removably coupled with the cylindrical casing at the lower end, adjacent to the writing tip. The pivot bar has incremental markings disposed thereon. The pivot bar is selectively received within the elongated recess of the cylindrical casing in a closed orientation. A needle assembly is mounted to the pivot bar, and is generally positioned near the upper end when the pivot bar is in the closed orientation. The needle assembly has an inner section and an outer section. The inner section is secured at the upper end of the pivot bar in an orthogonal relationship thereto. The outer section is pivotally coupled with the inner section. The outer section is linearly aligned with the inner section in a first orientation and perpendicular to the inner section in a second orientation. A clip member is adapted for being removably coupled with the needle of the pivot bar. The clip member has an opening in an upper end thereof for receiving the outer section of the needle therein. The clip member has an engagement button for selectively engaging the outer section of needle whereby the clip member can be used for attachment to a selected clothing article. The lower end of the pivot bar has a ring pivotally coupled thereto. The ring is positionable between the lower end of the cylindrical casing and the writing tip thereof whereby the pivot bar can be raised for positioning within the elongated recess or lowered to a position perpendicular to the cylindrical casing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-purpose writing instrument which has all the advantages of the prior art combined compass and pen instruments and none of the disadvantages.

It is another object of the present invention to provide a new and improved multi-purpose writing instrument which may be easily and efficiently manufactured and marketed.

It is a further object of the present invention to provide a new and improved multi-purpose writing instrument which is of durable and reliable construction.

An even further object of the present invention is to provide a new and improved multi-purpose writing instrument which is susceptible of a low cost of manufacture with regard to both materials and labor, and which accordingly is then susceptible of low prices of sale to the consuming public, thereby making such a multi-purpose writing instrument economically available to the buying public.

Even still another object of the present invention is to provide a new and improved multi-purpose writing instrument for allowing a number of different functions to be performed with a single instrument.

Lastly, it is an object of the present invention to provide a new and improved multi-purpose writing instrument including a cylindrical casing having an upper end, a lower end, and a cylindrical side wall therebetween. The lower end has a writing tip removably coupled thereto. The cylindrical side wall has an elongated recess formed therein extending between the upper end and the lower end. An elongated pivot bar is removably coupled with the cylindrical casing. The elongated pivot bar has an upper end and a lower end. The pivot bar is selectively received within the elongated recess of the cylindrical casing in a closed orientation. A needle assembly extends outwardly from the pivot bar. The lower end of the pivot bar has a ring pivotally coupled thereto. The ring is positionable between the lower end of the cylindrical casing and the writing tip thereof whereby the pivot bar can be raised for positioning within the elongated recess, lowered to a position perpendicular to the cylindrical casing, or removed from the cylindrical casing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
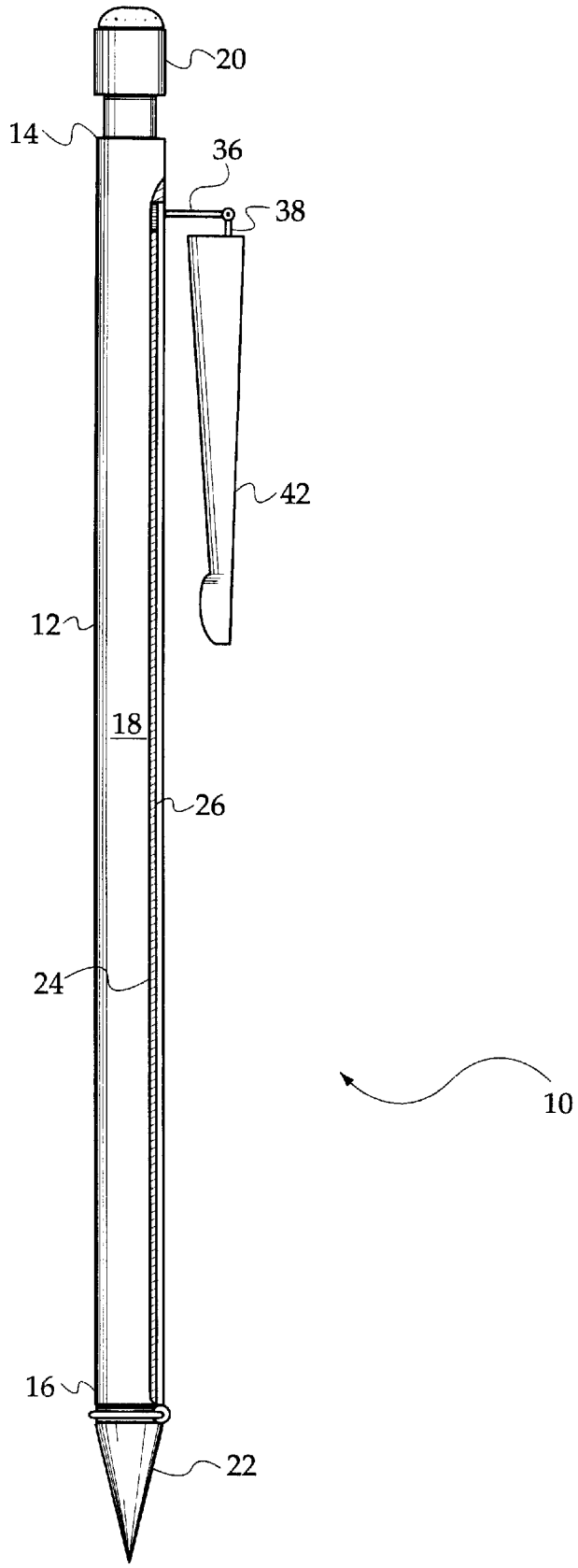
FIG. 1 is a front elevational view of the preferred embodiment of the multi-purpose writing instrument constructed in accordance with the principles of the present invention.
Figure 3:
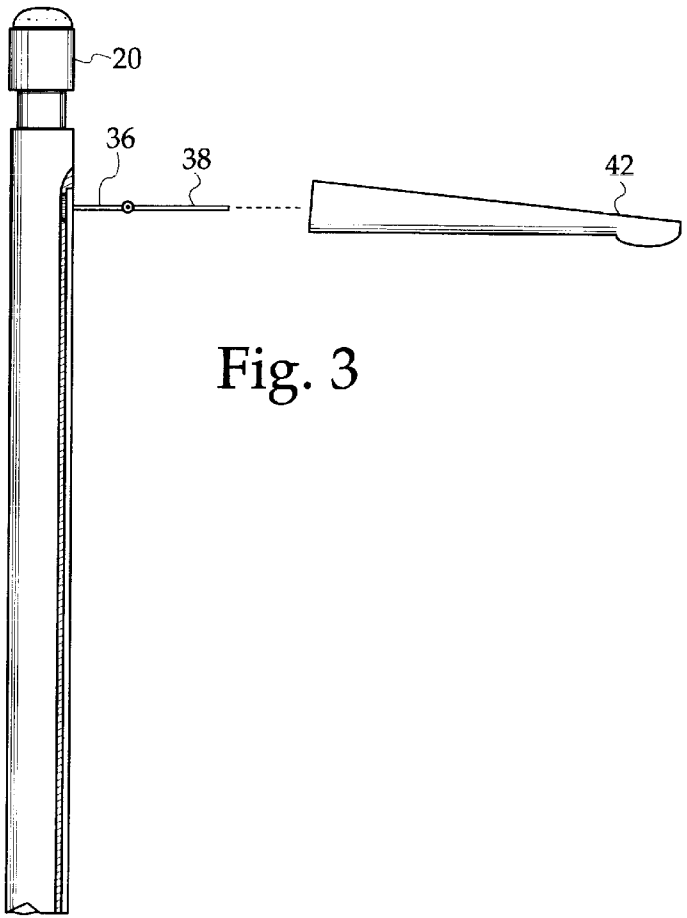
FIGS. 2 and 3 are enlarged front elevational views, showing interconnection between the clip and needle assembly.
Figure 2:
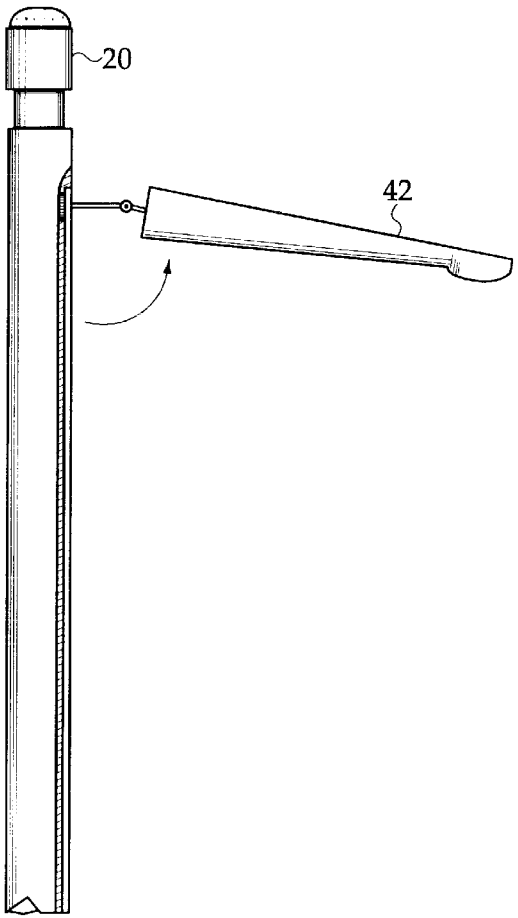
Figure 4:
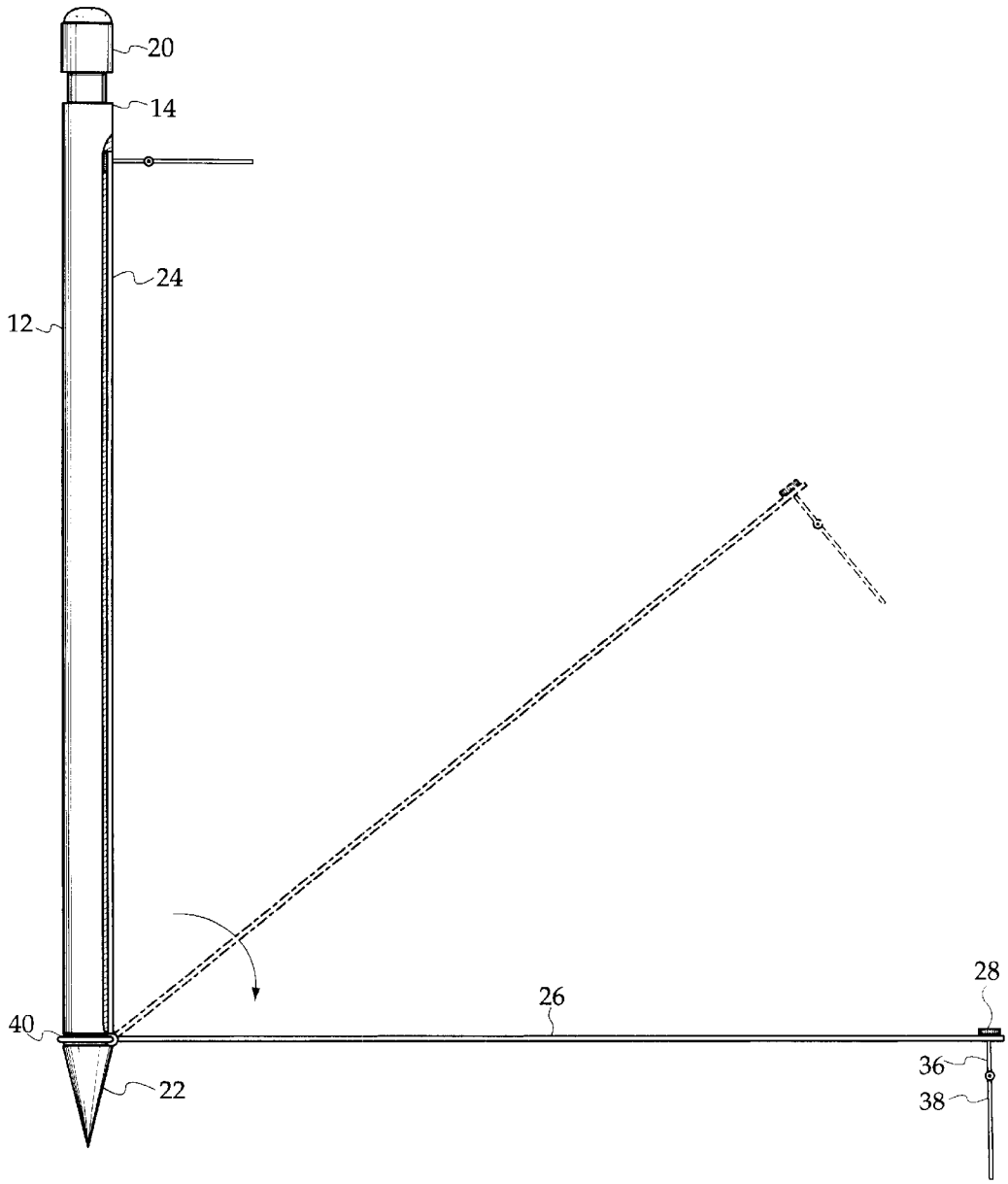
FIG. 4 is a diagrammatic front elevational view of the present invention, with the pivot bar illustrated in various positions.

With reference now to the drawings, and in particular, to FIGS. 1 through 7 thereof, the preferred embodiment of the new and improved multi-purpose writing instrument embodying the principles and concepts of the present invention and generally designated by the reference number 10 will be described.

Specifically, it will be noted in the various figures that the device relates to a multi-purpose writing instrument for allowing a number of different functions to be performed with a single instrument. In its broadest context, the device comprises a cylindrical casing, an elongated pivot bar, a needle assembly, and a clip member. Such components are individually configured and correlated with respect to each other so as to attain the desired objective.

The cylindrical casing 12 has an upper end 14, a lower end 16, and a cylindrical side wall 18 therebetween. The cylindrical casing 12 resembles a standard writing implement. Although referred to herein as "cylindrical"; the casing need not have a strictly round cross-section. It may readily have square, pentagonal, hexagonal, octagonal, or other shaped cross section. The upper end 14 has an eraser head 20 coupled thereto. The lower end 16 has a writing tip 22 removably coupled thereto. The cylindrical casing 12 may have lengths of lead disposed therein such that when the eraser head 20 is pressed, the lead incrementally extends out through the writing tip, in a manner similar to existing mechanical pencils. However, the writing tip 22 may also dispense ink. In general, the writing instrument may be a pen, pencil, marker, etc., while still adhering to the principles of the present invention.

The cylindrical side wall 18 has an elongated recess 24 formed therein extending between the upper end 14 and the lower end 16 of the cylindrical casing. The elongated pivot bar 26 has an upper end 28 and a lower end 30. The elongated pivot bar 26 is removably coupled with the cylindrical casing 12, such that the lower end 30 of the pivot bar 26 is pivotally connected at the lower end 16 of the cylindrical casing. The pivot bar 26 has incremental markings 32 disposed thereon, which may indicate measurements in familiar units, allowing the pivot bar 26 to be used as a ruler. The pivot bar 26 is selectively received within the elongated recess 24 of the cylindrical casing 12 such that the pivot bar 26 is in a "closed orientation". The needle 34 assembly extends outwardly from the upper end 28 of the pivot bar 26 when in the closed orientation. The needle assembly 34 has an inner section 36 and an outer section 38. When the pivot bar 26 is in the closed orientation, the inner section 36 is generally secured at the upper end 28 of the pivot bar 26. The outer section 38 is pivotally coupled with the inner section 36. The outer section 38 may be linearly aligned with the inner section 36 in a first orientation and perpendicular to the inner section 36 in a second orientation. In particular, when the pivot bar 26 is in the closed orientation, the outer section 38 generally extends perpendicular to the inner section 36, such that the outer section 38 extends downward—substantially parallel to the pivot bar 26.

The clip member 42 is adapted for being removably coupled with the outer section 38 of the needle assembly 34. The clip member 42 has an opening in an upper end thereof for receiving the outer section 38 of the needle assembly 34 therein. A catch may provided in the clip member to hold the outer section 38 securely within the needle clip member 42, and a catch release to allow the user to release the catch when it is desirable to remove the clip member 42 from the outer section 38. The clip member 42 can be used for attachment to a selected clothing article. Thus, when the pivot bar 26 is in the closed position, the clip member 42 is generally engaged with the needle assembly 34 to create a familiar pen or mechanical pencil configuration, which may be clipped onto a shirt pocket in a familiar fashion.

The lower end 30 of the pivot bar 26 has a ring 40 pivotally coupled thereto. The ring 40 is positionable between the lower end 16 of the cylindrical casing 12 and the writing tip 22 thereof whereby the pivot bar 26 is pivotally engaged with the ring 40 so that it can be raised for positioning within the elongated recess 24 or lowered to a position perpendicular to the cylindrical casing 12.

Figure 5:
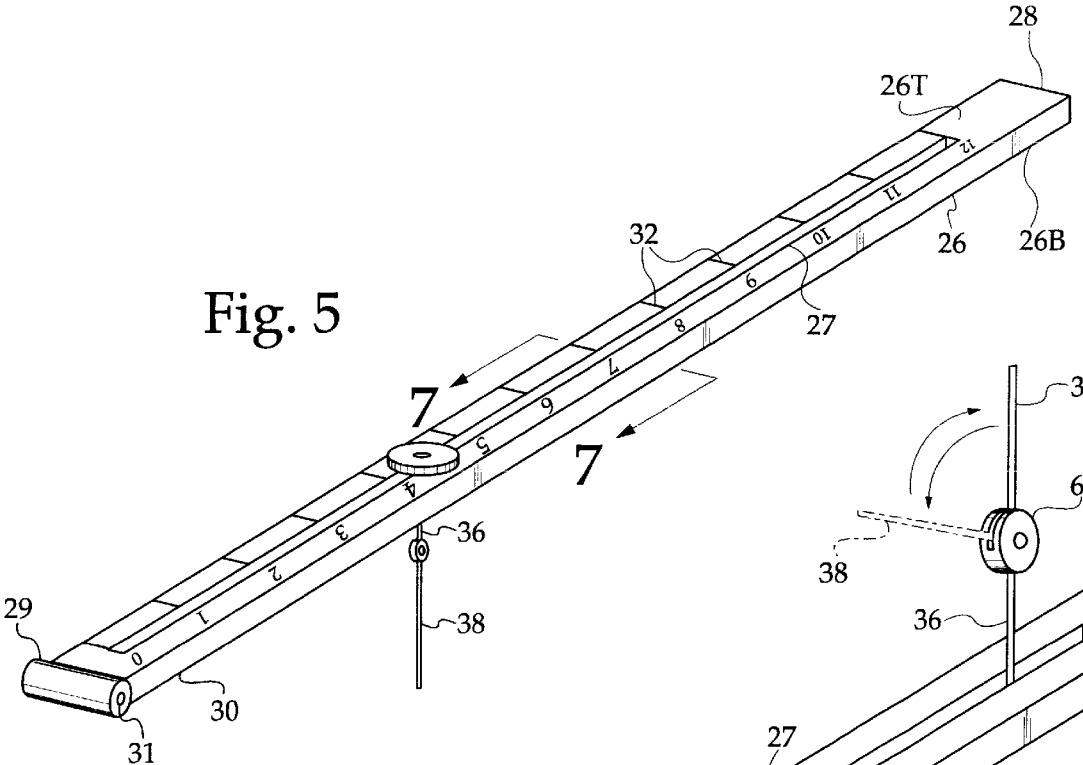
FIG. 5 is a perspective view, illustrating just the pivot bar and needle assembly of the present invention.
Figure 6:
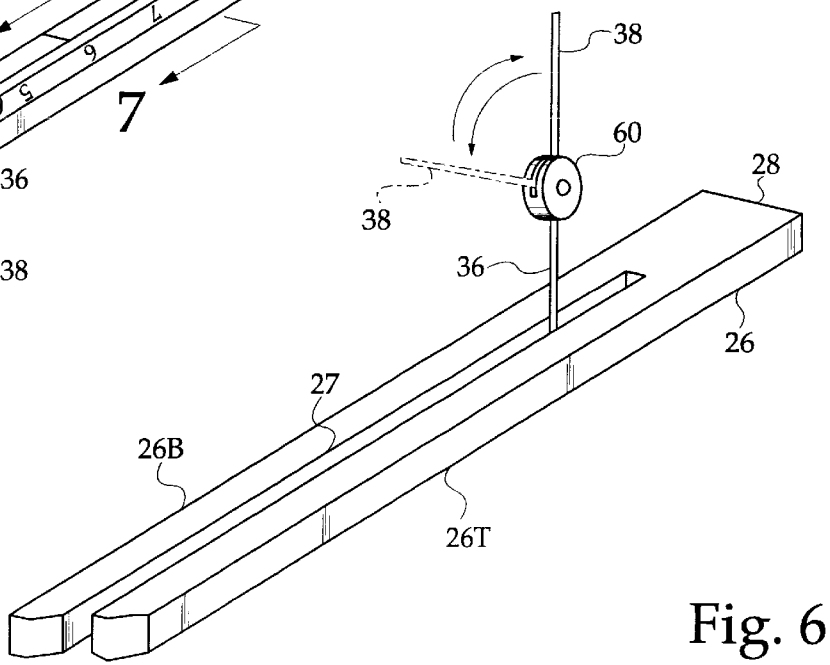
FIG. 6 is a perspective view, illustrating the needle assembly and bottom of the pivot bar.

Referring to FIG. 5 and FIG. 6, the pivot bar 26 has been removed from the cylindrical casing. A barrel hinge 29 is located at the lower end 30. The barrel hinge 29 has a barrel hinge bore 31 which extends transverse to the pivot bar 26. The barrel hinge and barrel hinge bore 31 accommodate the ring 40 (FIG. 1 and FIG. 4), such that the ring 40 may be a C-shaped member which extends around the cylindrical casing just above the writing tip 22, and hooks into the barrel hinge bore 31 from both sides—allowing the pivot bar 26 to pivot thereon. The pivot bar 26 has a top 26T and a bottom 26B. The pivot bar 26 has a longitudinal slot 27 which extends substantially between the upper end 28 and lower end 30. The needle assembly 34 is mounted within the longitudinal slot 27 for slidable movement therealong.

Figure 7:
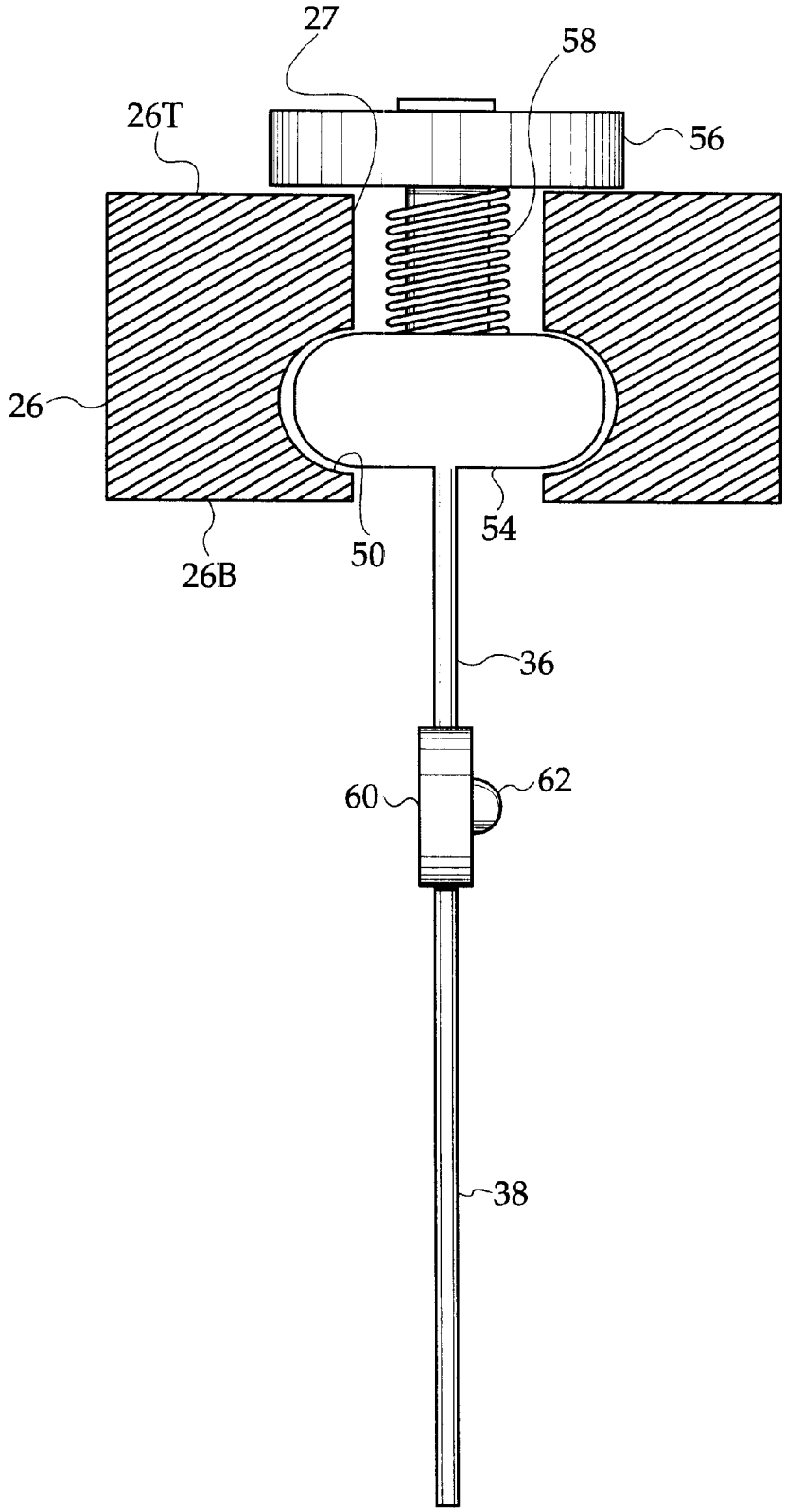
FIG. 7 is a cross sectional view, taken generally in the direction of line 7—7 in FIG. 5, illustrating the slidable mounting of the needle assembly within the pivot bar.

Referring to FIG. 7, the pivot bar 26 has a cross slot 50, located between the top 26T and bottom 26B, and extending longitudinally along the pivot bar 26, such that the cross slot 50 forms an enlargement of the longitudinal slot 27 within the pivot bar 26. In addition, the needle assembly 34 further includes a body 54 which is sized to fit and slide within the cross slot 50. A thumbwheel 56 is located along the top 26T, and is connected to the body 56 with a threaded rod 58 which extends in the longitudinal slot 27. The threaded rod 58 is fixed to the thumbwheel 56 and threads into the body 56. Accordingly, by turning the thumbwheel 56, the body 56 is pulled toward the thumbwheel 56, urging the thumbwheel 56 against the top 26T and urging the body against the cross slot 50, holding the needle assembly 34 in a fixed longitudinal position by using friction.

The inner section 36 extends from the body 56, opposite from the threaded rod 58. The inner section and outer section 38 are linked by a hinge 60. The hinge 60 allows the inner section 36 and outer section 38 to selectively extend coaxially, or extend orthogonally to each other. The hinge 60 may be constructed with a locking mechanism so that the outer section and inner section 36 "lock" with respect to each other, in which case a release button 62 may be provided to release the locking mechanism.

In use, the present invention can be used as a standard writing instrument, a compass, a ruler, or a straight edge. To use as a compass, the clip member 42 is removed from the needle 34 by pulling clip member off of the outer section 38 of the needle. The pivot bar 26 is then lowered to a position perpendicular to the cylindrical casing 12. The outer section 38 in then positioned in the first orientation, wherein the inner section 36 and outer section 38 are parallel and coaxial, and the outer section 38 placed on a recipient surface. The user can maneuver the cylindrical casing 12 around the outer section 38 of the needle assembly 34 to draw a circle. Note FIG. 4. It should be noted that the needle 34 can be slidably coupled with the pivot bar 26 so that circles of varying diameters can be made simply by adjusting the position of the needle 34 within the longitudinal slot 27 of the pivot bar 26. To use as a ruler, the writing tip 22 is removed to allow the ring 40 to be disengaged. The writing tip 22 can then be reconnected to the lower end 16 of the cylindrical casing 12. The pivot bar 26 can then be laid flat on a recipient surface to be used as a ruler. The incremental markings 30 allow proper lengths to be measured in any familiar unit system.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-purpose writing instrument for allowing a number of different functions to be performed with a single instrument comprising, in combination:

a cylindrical casing having an upper end, a lower end, and a cylindrical side wall therebetween, the upper end having an eraser head coupled therewith, the lower end having a writing tip removably coupled thereto, the cylindrical side wall having an elongated recess formed therein extending between the upper end and the lower end;

an elongated pivot bar removably coupled with the cylindrical casing, the elongated pivot bar having an upper end and a lower end, the pivot bar having incremental markings disposed thereon, the pivot bar being removably received within the elongated recess of the cylindrical casing in a closed orientation, the pivot bar having a longitudinal slot;

a needle assembly, slidably mounted within the longitudinal slot, the needle assembly having an inner section and an outer section, the inner section extending from the pivot bar in an orthogonal relationship thereto, the outer section being pivotally coupled with the inner section, the outer section being linearly aligned with the inner section in a first orientation and perpendicular to the inner section in a second orientation, the lower end of the pivot bar having a ring couplable thereto, the ring being positionable between the lower end of the cylindrical casing and the writing tip thereof wherein the pivot bar can be raised for positioning within the elongated recess, lowered to a position perpendicular to the cylindrical casing, and removed by removing the writing tip; and a clip member adapted for being removably coupled with the outer section of the needle assembly, the clip member having an opening in an upper end thereof for receiving the outer section of the needle therein, whereby the member can be used for attachment to a selected clothing article.

2. A multi-purpose writing instrument for allowing a number of different functions to be performed with a single instrument comprising, in combination:

a cylindrical casing having an upper end, a lower end, and a cylindrical side wall therebetween, the lower end having a writing tip removably coupled thereto, the cylindrical side wall having an elongated recess formed therein extending between the upper end and the lower end;

an elongated pivot bar having an upper end and a lower end, the lower end of the elongated pivot bar removably coupled with the lower end of the cylindrical casing, the pivot bar being received within the elongated recess of the cylindrical casing whereby the pivot bar can be raised for positioning within the elongated recess or lowered to a position perpendicular to the cylindrical casing, said pivot bar further comprising a longitudinal slot extending substantially between the upper end and the lower end; and a needle assembly mounted to the pivot bar, the needle assembly comprising an outer section and an inner section, the outer section selectively extending coaxially with the inner section and selectively extending orthogonal thereto, wherein the needle assembly is mounted for slidable movement within the longitudinal slot of the pivot bar.

3. The multi-purpose writing instrument as set forth in claim 2, wherein the pivot bar has incremental markings disposed longitudinally thereon, adjacent to the longitudinal slot.

4. The multi-purpose writing instrument as set forth in claim 3, wherein the lower end of the pivot bar has a ring pivotally coupled thereto, the ring being positionable between the lower end of the cylindrical casing and the writing tip thereof.

5. The multi-purpose writing instrument as set forth in claim 4, wherein the outer section is linearly aligned with the inner section in a first orientation and perpendicular to the inner section in a second orientation, and further comprising a clip which is mateable with the outer section when the needle assembly is in the second orientation so that the writing instrument can be clipped onto an article of clothing.

6. The multi-purpose writing instrument as recited in claim 5, wherein the pivot bar further comprises a top, a bottom, and a cross slot located between the top and bottom and extending longitudinally within the pivot bar; the needle assembly further comprises a body, the inner section of the needle assembly extending from the body; and wherein the body slides within the cross slot to adjust the position of the needle assembly along the pivot bar.

7. The multi-purpose writing instrument as recited in claim 6, wherein the needle assembly further comprises a thumbwheel, located at the top surface of the pivot bar, and a threaded rod which extends in the longitudinal slot and connects the thumbwheel and the body such that when the thumbwheel is rotated it causes the threaded rod to thread into the body to tighten the thumbwheel against the pivot bar to fix the longitudinal position of the needle assembly along the pivot bar.

* * * * *